US006145898A

United States Patent [19]

Onderka et al.

[11] Patent Number: 6,145,898

[45] Date of Patent: Nov. 14, 2000

[54] DOOR LOCKING DEVICE FOR ELECTRIC APPARATUS

[75] Inventors: Oswald Onderka; Günther Hengelein, both of Altdorf; Hubert Harrer, Hilpoltstein, all of Germany

[73] Assignee: Ellenberger & Poensgen GmbH, Nuremburg, Germany

[21] Appl. No.: 09/069,943

[22] Filed: Apr. 30, 1998

[30] Foreign Application Priority Data

Apr. 30, 1997 [DE] Germany ..... 197 18 219
Apr. 8, 1998 [DE] Germany ..... 198 15 591

[51] Int. Cl.[7] ..... E05C 3/14

[52] U.S. Cl. ..... 292/228; 292/198; 292/203; 292/302; 292/341.15; 292/DIG. 69

[58] Field of Search ..... 292/228, DIG. 69, 292/300, 302, 150, 145, 341.15, 341.17, 121, 219, 202, 209, DIG. 61, 128, 99, 102, 198, 203; 70/DIG. 52

[56] References Cited

U.S. PATENT DOCUMENTS

| | | | |
|---|---|---|---|
| 1,909,753 | 5/1933 | Canedy | 292/128 |
| 2,001,443 | 5/1935 | Williams | 292/DIG. 61 |
| 2,842,075 | 7/1958 | Ratiaczak | 292/341.16 |
| 3,617,957 | 11/1971 | Brighenti | 337/77 |
| 3,701,617 | 10/1972 | Crawford et al. | 292/302 |
| 3,892,933 | 7/1975 | Rocchitelli | 337/77 |
| 3,966,242 | 6/1976 | Vitalis | 292/19 |
| 4,032,180 | 6/1977 | Pohl | 292/341.16 |
| 4,262,945 | 4/1981 | Paulson | 292/89 |
| 4,609,233 | 9/1986 | Walla | 312/219 |
| 4,620,735 | 11/1986 | Heydner | 292/144 |
| 4,988,132 | 1/1991 | Rocchitelli | 292/144 |
| 5,062,668 | 11/1991 | Onderka et al. | 292/25 |

FOREIGN PATENT DOCUMENTS

| | | |
|---|---|---|
| 0 347 592 | 12/1989 | European Pat. Off. . |
| 0 481 503 | 4/1992 | European Pat. Off. . |
| 34 26 738 | 1/1986 | Germany . |
| 36 05 960 | 8/1987 | Germany . |

*Primary Examiner*—B. Dayoan
*Assistant Examiner*—Clifford B Vaterlaus
*Attorney, Agent, or Firm*—Venable; George H. Spencer; Gabor J. Kelemen

[57] ABSTRACT

A door locking device for an electrical apparatus, in particular a household appliance, including a lock having a locking slide, supported in the lock and movable back and forth between an opening position and a closing position, having a blocking device for arresting the locking slide in its closing position, and having a locking tang (1, 51) which drops into the lock as the appliance door is being closed and once the appliance door is in its closed state is in engagement with the locking slide, in which a gear mechanism is permanently operative between the locking slide and the locking tang, for converting the drop-in motion of the locking tang upon closure or the dropping-out motion of the locking tang upon opening of the appliance door into a displacement motion of the locking slide (9, 69) once the blocking device is deactivated, and having a compulsory guidance of the locking tang in the lock in such a way that every opening motion of the appliance door from any arbitrary door position, once the blocking device is deactivated, necessarily moves the locking slide in the direction of its opening position.

10 Claims, 18 Drawing Sheets

DOOR LOCKING DEVICE FOR ELECTRIC APPARATUS

BACKGROUND OF THE INVENTION

The invention relates to a door locking device for electrical apparatuses, in particular household appliances. One such door locking device is known from EP-A 0 347 592, whose subject is likewise an invention assigned to the present Applicant. In this previously known locking device, a lock is provided on the electrical apparatus and a locking tang is provided on the appliance door. The locking tang in this known appliance is a lever pivotably supported on a pivot joint. On its end remote from the pivot joint, this go lever has a hook part. With the hook part, the lever reaches through a locking slide, disposed longitudinally displaceably in the lock, in an engagement opening. The back side of the hook part, which forms the face end of the lever, is embodied here as a guide chamfer, so that as the lever is introduced into the lock it moves the locking slide into its closing position. To keep the lever with the hook part in the closing position, the lever is spring-loaded. When the door has been closed, the hook part subjects the locking slide to the spring force and engages a suitably embodied rear-engagement part of the lock from behind.

A disadvantage here is that the properly locked appliance door can be opened from inside, or if the spring mechanism is defective, only by exerting a great deal of force, because the leverlike locking tang with the hook part has to be destroyed in the process. This is particularly disadvantageous in appliances of large capacity, such as washing machines with large tubs. It is in fact impossible to preclude a child at play from crawling into such a large tub and then locking the appliance door. The child inside the machine is as a rule no longer able to open the appliance door because it is not strong enough to destroy the locking tang that has the hook part.

Another problem with electrical apparatuses with revolving parts, such as washing machines, dryers or spin dryers with a rotating drum, is that the appliance door must be solidly closed both during operation and after the appliance is turned off until the revolving parts come to a stop. It is already known from the prior art disclosed in EP-A 0 347 592 to provide the aforementioned longitudinally displaceable locking slide in the lock. This locking slide can be displaced back and forth between an opening position and a closing position. Provisions are also disclosed there for securing the locking slide in its closing position until the revolving parts come to a stop. However, in the known locking devices, the problem is that when the appliance door is open, the locking slide can easily be moved from outside from its opening position to its closing position using household tools, without the appliance door actually being closed. Hence there is a possibility of undesired manipulation of the locking slide. In conjunction with this undesired possibility of manipulation, there is in particular the risk that after the locking slide has been manipulated into its closing position, the revolving parts of the machine can be set into motion while the appliance door is open. If these revolving parts then run at high rotary speed with the appliance door open, they present a considerable risk of injury. For instance, there is the risk that body appendages extended into a revolving part will be caught and actually torn from the body.

SUMMARY OF THE INVENTION

In view of these problems, an object of the invention is to improve a door locking device from a standpoint of safety.

The door locking device according to the invention has a locking slide that is to be moved back and forth between its opening and its closing position and is supported longitudinally displaceably in the lock. This locking slide can be arrested in its closing position by means of a blocking device—of the kind known for instance from EP-A 0 347 592. Not until this blocking device is activated can the electrical apparatus even start running. The invention is based on the fundamental concept of utilizing this blocking device as an actual closure device for appliance operation. The locking tang that drops into the lock of the door locking device of the invention when the appliance door has been closed therefore serves primarily as a means of mechanical prelocking for the appliance door. The invention therefore makes use of the discovery that the activated blocking device fixes the locking slide so securely and reliably in its closing position that any further securing of the appliance door is no longer at all necessary.

The mechanical detent locking, known from the prior art, of the appliance door by means of a hook is replaced, in the door locking device of the invention, with a gear mechanism that is permanently operative between the locking slide and the locking tang. This gear mechanism is designed such that the tang is always guided in compulsory fashion such that when the blocking device is deactivated and the tang has at the same time been introduced into the lock, any motion of the appliance door at the same time brings about a displacement motion of the locking slide. In this connection it does not matter in the least whether the appliance door is moved properly by means of a manual motion exerted from the outside, or whether the appliance door is pushed open from the interior of the appliance, for instance. Even when the door is pushed open from inside, the gear mechanism connection between the locking tang and the locking slide always assures that the locking slide will move into its opening position when the blocking device has been deactivated. This in turn assures that a child unintentionally trapped in a washing machine drum, for instance, can always escape from the appliance again without outside help.

At the same time, the gear mechanism connection between the locking slide and the locking tang accomplishes a reliable conversion of the locking slide from its opening position to its closing position, however, so that the locking slide always reliably reaches its set-point position for activating the blocking device. Furthermore, the gear mechanism accomplishes reliable mechanical locking of the door once the tang has dropped all the way into the lock.

The invention can provide a wedge thrust gear mechanism that is permanently operative between the locking slide and the locking tang. The invention can also provide a cam drive operative between the locking slide and the locking tang.

The locking tang, which is conventionally fixed on the appliance door, is kinematically coupled to the locking slide via a wedge thrust gear mechanism. By way of example, wedge thrust gear mechanisms are known from "Konstruktionselemente der Feinmechanik" [Construction Elements in Precision Mechanics], Second Edition, p. 537, Carl Hanser Verlag, München Wien, 1993, ISBN 3-446-16530-4.

To make the wedge thrust gear mechanism, the locking tang is embodied as a thrust wedge, which engages a correspondingly embodied wedge guidance groove on the locking slide. With the aid of the wedge thrust gear mechanism, it is possible for the motion, proceeding in the insertion direction of the locking tang upon closure of the appliance door, to be converted into the displacement motion of the locking slide that extends perpendicular to the insertion direction. In this way, the locking slide moves out of its opening position when the appliance door is open into its closing position. The locking slide that has moved into the closing position is then prevented in a known manner (EP-A 0 347 592), by means of a thermobimetal-controlled, electric blocking device, from sliding back into its opening position. However, this blocking device is not activated until the electrical apparatus is turned on. The blocking device also serves to release the locking slide in delayed fashion, in order to assure that revolving parts will have come back to a full stop before the appliance door is opened.

However, since the electric, thermobimetal-controlled blocking device is not activated until the electrical apparatus is turned on, it is possible, with the appliance turned off, to open the appliance door from the inside by exerting only slight force, because the wedge thrust gear mechanism acts in the same way in both directions of motion. Since the thrust wedge is guided in compulsory fashion in the wedge guidance groove, the locking slide is also guided in compulsory fashion on the locking tang, in such a way that when the appliance door is pushed open from inside, the locking tang necessarily returns the locking slide to its opening position. In this way, a child that has gotten inside a machine, such as into the drum of a washing machine, can easily open the appliance door from inside and get back out again.

Assure that the wedge thrust gear mechanism will act in the same way in both directions, so that both opening and closing of the appliance door is equally possible both from the inside and from the outside. A child or pet who has gotten into the interior of the appliance can therefore get back out of the machine easily and without external aid. The invention provides angle ratios that are considered to be especially advantageous.

In the path guide formed by the thrust wedge and the wedge guidance groove, two parallel wedge faces are embodied on the thrust wedge, and correspondingly two parallel guide faces are embodied in the wedge guidance groove. In this way, one of the wedge faces together with the associated guide face acts as a face to be pushed on when shutting the appliance door, while the other, remote wedge face together with its associated guide face acts as face to pull on to open the appliance door. These provisions in turn favor the capability of opening the appliance door from the outside and the inside with the same expenditure of force.

The centering rib may be embodied either on only one wedge face or on both wedge faces. The centering rib centers the thrust wedge on the one hand upon introduction into the wedge guidance groove and on the other contributes to preventing the elements of the wedge thrust gear mechanism from being canted relative to one another as the appliance door is being closed.

The invention also pertains to prelocking of the appliance door. As noted above, the actual locking of the appliance door is effected by means of the electrical blocking device of the locking slide in its closing position. The prelocking is intended to prevent the appliance door from coming open by mistake before the appliance has been turned off. The invention on the one hand produces a loud snapping noise as the rollers drop into the channels in the side faces of the thrust wedge. Along with this acoustical signal to the user that the appliance door has reached its closing position, the snapping of the rollers into the channels makes for a strong snapping feeling in the user's hand. This prelocking signals the user that the locking tang has correctly locked in detent fashion in the lock and at the same time signals that the locking slide has moved all the way into its closing position.

The runup cone of an embodiment of the invention proposed in claim 9, finally, has a dual function. First, it promotes the introduction of the thrust wedge, acting as a locking tang, into the lock. It is in fact at the runup cone that the two cylindrical rollers begin to rotate, while the cone continuously spreads apart the two legs of the leaf spring that support the rollers, before the rollers in a sense roll into the channels. Second, the same force that was required to slide the rollers into the channels is expended again to rotate the rollers out of the channels. As soon as they meet the runup cone, the rollers, driven by the spring force of the leaf spring legs, reinforce the opening motion of the thrust wedge and thus act as an additional drive mechanism for the locking slide from its closing position to its opening position. In this way, together with the leaf spring the rollers reinforce the opening motion of the appliance door.

The invention also pertains to a design of the locking slide that is advantageous from a production standpoint. The locking slide has a rectangular opening, known in principle from EP-A 0 347 592. According to the invention, this opening is embodied as a bearing eye in such a way that in the final mounted state a saddle is fixed in it. A wedge guidance groove is formed into the saddle at the same time. An embodiment of the saddle as an injected molded plastic part that can be made economically, is especially advantageous from a production standpoint. For the final mounting of the locking slide, the saddle need merely be inserted or snapped into the rectangular bearing eyelet and is thus solidly connected to the locking slide.

A second embodiment of the locking device according to the invention is structurally closer than the above-described first exemplary embodiment to the locking device known from the prior art (EP-A 0 347 592). In a manner similar to the prior art, a locking tang is provided, here embodied as a guide rod. This locking tang is pivotably supported in a bearing block. Instead of the hook, which in the prior art is embodied on the free end of the guide rod, the locking tang has a cam disk. This cam disk engages a scanning opening of the locking slide. This scanning opening is preferably embodied analogously to the bearing eyelet in the locking slide. While in this embodiment as well the locking slide is capable only of executing a translational motion between its opening position and its closing position, the locking tang can not merely drop into the lock but can also be pivoted by a certain amount. This pivotability on the one hand and the geometry of the cam disk on the other are adapted to one another in such a way that in this embodiment as well, a pulling or pushing motion exerted on the appliance door is always converted into a displacement motion of the locking slide.

The V-shaped cam disk according to the invention is especially advantageous. The face end of this locking tang is embodied similarly to the face end of a conventional hook, as a lead-in chamfer. However, in contrast to the prior art, there is also a second chamfer, namely the second leg of the V of the cam disk, remote from the face end of the locking tang. While the apex of the V-shaped cam disk acts upon the locking slide in order to move it from its opening position to its closing position, the leg of the V of the cam disk remote from the face end or the free end of the locking tang slides with its outer surface along the edge of the introduction opening of the lock housing. This leg of the V thus forms a sliding guide chamfer for the locking tang. The angle of inclination of this sliding guide chamfer relative to the body of the locking tang determines the pulling force required to open the appliance door.

It is assured in turn that when the appliance door is pulled open or pushed open, with the blocking device activated, the sliding guide chamfer slides along the edge of the introduction opening in the lock housing and thus throws out the locking tang from the lock while simultaneously displacing the locking slide to its opening position.

The V-shaped embodiment of the cam disk in turn produces a clearly audible clacking noise upon insertion of the locking tang, as soon as the locking tang has been thrust, by means of its introduction chamfer on its end face, through the introduction opening of the lock housing into the scanning opening in the locking slide, specifically just at the moment when the apex of the V-shaped cam disk acts upon the opening edge of the scanning opening. In other words, the locking tang with its V-shaped cam disk acts in the manner of a feeler prong on the edge of the scanning opening. In this embodiment as well, the locking slide on the one hand and the locking tang on the other cooperate via a permanently engaged compulsory gear mechanism that is guided in compulsory fashion.

The invention also provides a locking device has a thrust latch for the locking slide, and this latch is operative when the appliance door is open. This thrust latch effectively prevents the locking slide from being unintentionally displaced from its opening position into its closing position when the appliance door is open. Hence the locking slide cannot be manipulated from outside, which assures that rotating parts in the electrical apparatus can be set into motion only once the appliance door is indeed securely closed. The thrust latch can be released in fact only by means of the locking tang typically mounted on the appliance door. As a result of the typical mounting of the locking tang on the appliance door and of the lock on the appliance, the locking slide fixed in the lock is only poorly accessible from outside and thus is harder to manipulate. The locking tang in this invention consequently has the dual function of a locking part for the appliance door, on the one hand, and of an unlocking part for the thrust latch, on the other.

The invention also provides pertain to advantageous versions of the latch pin of the thrust latch. Here the face ends of bracing spring legs are used as latch pins. The use of bracing spring legs has the advantage that they rest with high initial tension on the latch stop and at the same time can easily be put into their unlocking position by a suitably embodied locking tang, so that they can move the locking slide into its closing position when the appliance door is in its closed state.

The invention also provides that the carriage is operated not only as a groove carrier for the wedge guidance groove but moreover carries the latch stops for the thrust latch.

The invention also provides a particular embodiment and disposition of the bracing spring in the region of the wedge guidance groove, as a result of which unintended manipulation of the locking slide when the appliance door is open is made still more difficult.

The invention also provides a dual function of the runup cone on the thrust wedge in the form of a spreader cone and thus in the form of an unlocking part for the thrust latch.

The invention in claim 18 with the second exemplary embodiment of the gear mechanism in the locking device defined by claims 12–17.

The invention will be described in further detail along with further advantages and details, in terms of the exemplary embodiments described in the drawing figures.

DETAILED DESCRIPTION OF THE PREFERRED EMBODIMENTS

Figure 1:
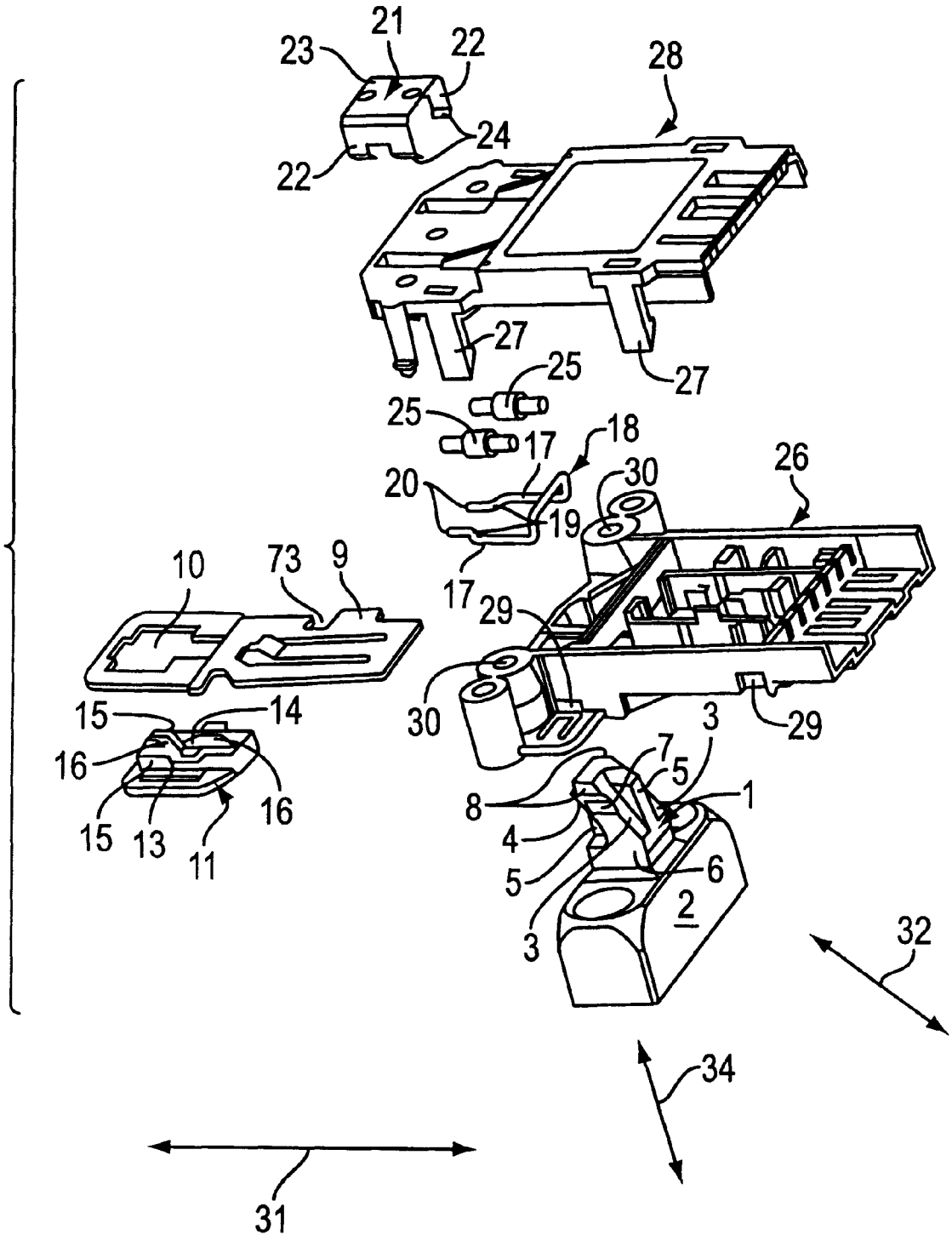
FIG. 1 is an exploded view of a first exemplary embodiment of the invention.

In the first exemplary embodiment of the invention, the locking tang 1 has a mounting flange 2 on its end toward the appliance door, the latter not shown in the drawings. Also embodied on the locking tang 1 are an upper wedge face 3 and a lower wedge face 4. Both the upper wedge face 3 and the lower wedge face 4 are split in two by a centering rib 5 extending in the middle of each. Channels 7 are also formed into the side faces 6, extending perpendicular to the wedge faces 3, 4, of the locking tang 1. In the region of the free end of the locking tang 1 remote from the mounting flange 2, finally, the side faces 6 are beveled to form a runup cone 8.

The locking slide 9 is pierced on one end by a rectangular bearing eyelet 10. A saddle 11 can be inserted into the bearing eyelet 10. A wedge guidance groove 12 is formed into the saddle 11. The wedge guidance groove 12 in turn has a lower guide face 13 and an upper guide face 14. The lower guide face 13 is flanked on the sides by the latch stops 15. Analogously to the wedge faces 3, 4, the guide faces 13, 14 are each split in two by a centrally extending centering slot 16.

In the finally mounted state, two latch stops 15, disposed on the saddle 11 next to the wedge guidance groove 12 and having bracing spring legs 17 of a bracing spring 18, cooperate with one another. The bracing spring legs 17 are provided with right-angle bends 19. The right-angled regions of the bracing spring legs 17 finally end at the bracing spring face ends 20.

A leaf spring 21 is U-shaped, such that its legs 22 are bent at right angles away from the leaf spring body 23. One cylindrical roller 25 is rotatably supported on the face ends 24 of each of the two leaf spring legs 22.

Finally, the lock housing is formed by the housing bottom 26 and the housing cap 28, which is locked in detent fashion on the housing bottom 26 by means of the detent hooks 27. For fixing the housing cap 28 to the housing bottom 26, detent hooks 27 integrally formed by injection molding on the housing cap 28 engage corresponding detent recesses 29 of the housing bottom 26.

With the housing closed (FIG. 2), the saddle 11 is fixed in the bearing eyelet 10 of the locking slide 9. The locking slide 9 is supported longitudinally displaceably in the displacement direction 31 in the housing formed by the housing bottom 26 and the housing bottom 28. In the opening position, shown in FIG. 2, of the locking slide 9 for the locking tang 1, which is therefore note shown in the view of FIG. 2 because it has not snapped into place in the lock, the face ends 20 of the bracing spring rest as latch pins on the latch stop 15. Because of this contact of the face ends 20 of the bracing spring with the two latch stops 15 carried by the saddle 11, the longitudinal displaceability of the locking slide 9 in the displacement direction 31 is cancelled. In other words, the locking slide 9 is latched in its opening position.

Figure 2:
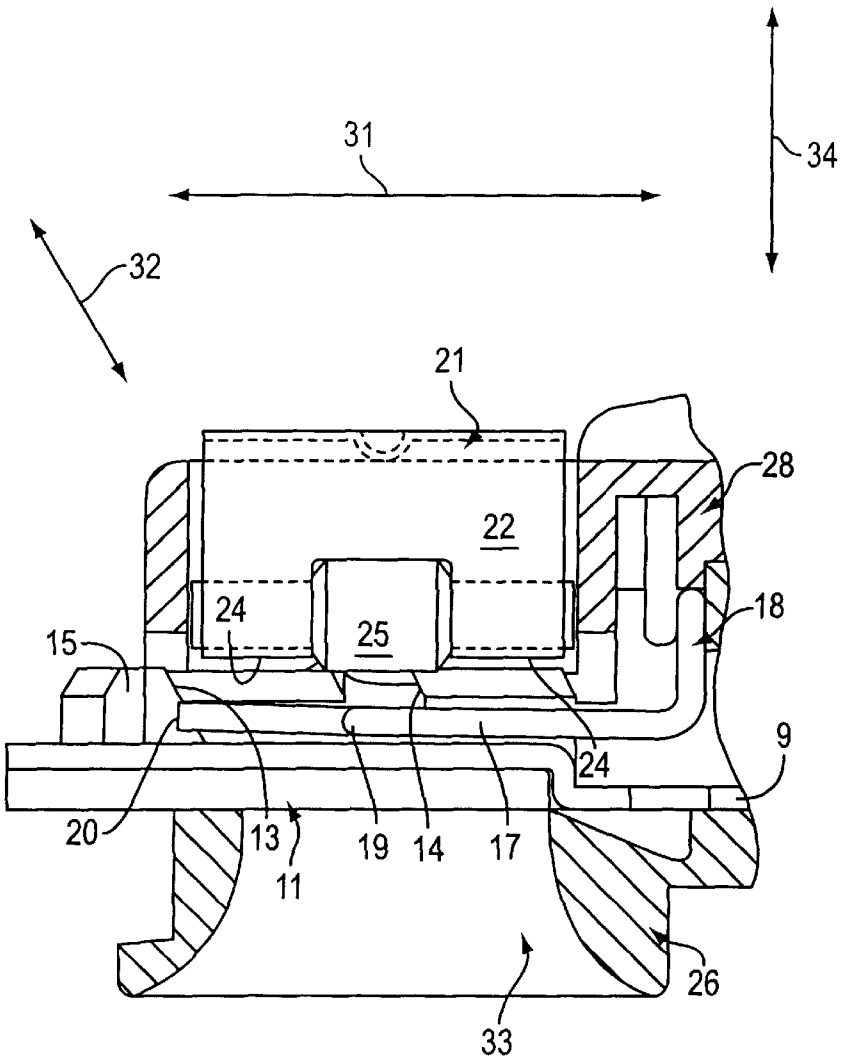
FIG. 2 is a longitudinal section through the lock.

Finally, the two guide faces 13, 14 that form the wedge guidance groove 12 can be seen in FIG. 2. The lower guide face 13 and the upper guide face 14 of the wedge guidance groove 12 extend parallel to one another. With respect to the displacement direction 31 of the locking slide 9, they are positioned obliquely by an angle of 30°. The path guide formed by the guide faces 13, 14 together with the wedge faces 3, 4 consequently has a path guidance direction 32 that extends at an angle of 30° from displacement direction 31.

The mode of operation of the locking device is as follows: The locking tang 1 is inserted into the introduction opening 33, which is left open in the housing bottom 26, in the insertion direction 34 that extends perpendicular to the displacement direction 31. The locking tang 1 here slides with the surfaces of its centering ribs 5 along the opening edges 35 of the introduction opening 33. The locking tang 1 is consequently guided in compulsory fashion in the introduction opening 33, in such a way that it cannot be displaced in the displacement direction 31 that extends perpendicular to the insertion direction 34.

The wedge faces 3, 4 that form the thrust wedge of the wedge thrust gear mechanism then engage the wedge guidance groove 12, in such a way that the upper wedge face 3 rests on the upper guide face 14, and correspondingly the lower wedge face 4 rests on the lower wedge face 13.

Figure 7:
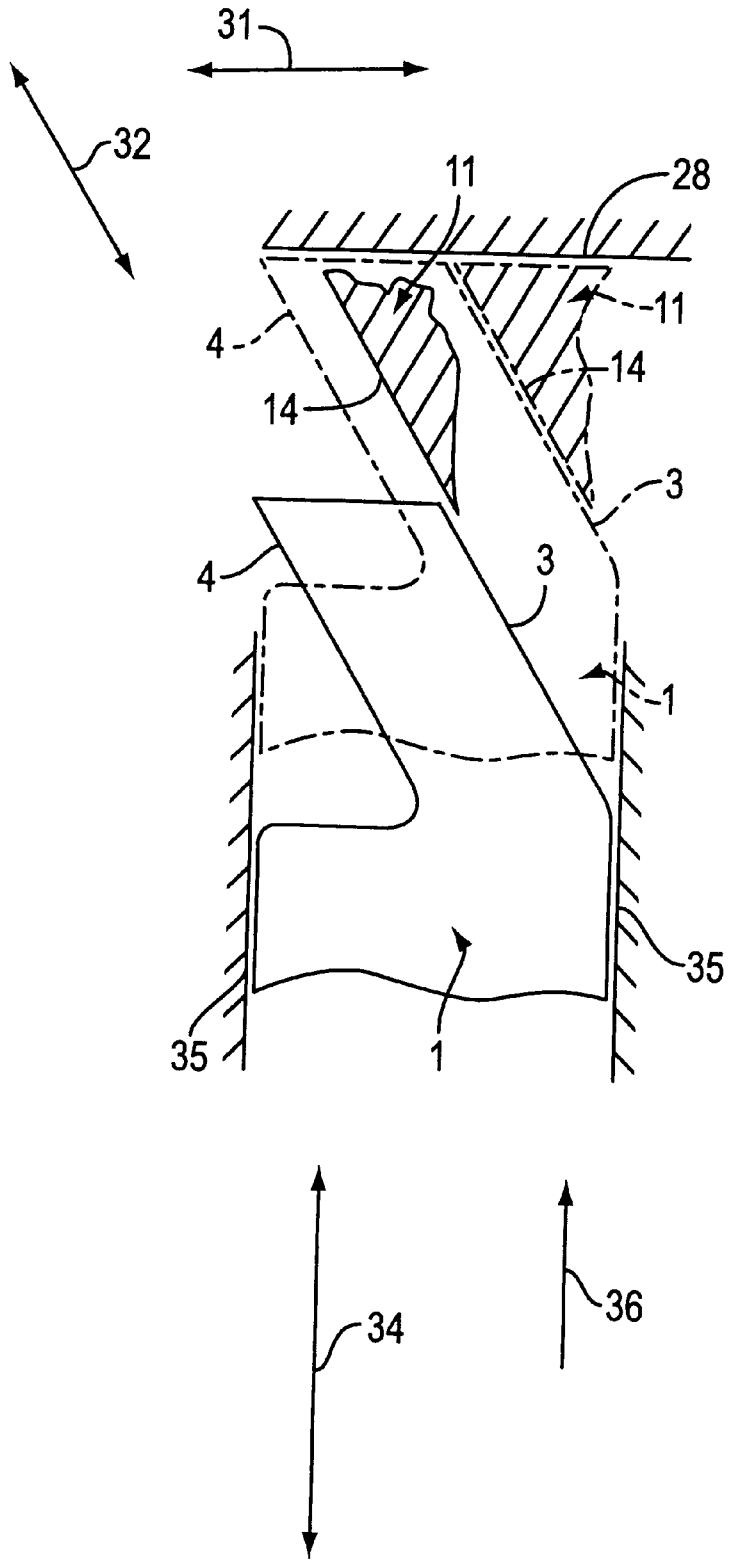
FIG. 7 is a basic illustration of the mode of operation of the wedge thrust gear mechanism upon closure of the appliance door.

Upon insertion of the locking tang 1 in the insertion direction 34, the insertion force factor 36 (FIG. 7) acts on the locking tang 1. As a consequence, the insertion force is transmitted via the upper wedge face 3 to the upper guide face 14 of the wedge guidance groove 12. Since the locking tang 1 is guided in compulsory fashion in the insertion direction 34 along the opening edges 35, and the locking slide 9 is likewise guided in compulsory fashion on the housing cap 28 or housing bottom 26 in the displacement direction 31, the saddle 11—as schematically indicated in FIG. 7—is moved to the right in the displacement direction 31 as shown in FIG. 7. With the saddle 11, the locking slide 9 is moved from its opening position to the right, in terms of the drawings, to its closing position. In FIG. 7, the locking tang 1 and the saddle 11 are shown once with solid lines, to indicate the opening position of the locking slide 9. The locking tang 1 and saddle 11 are also shown in dot-dashed lines. In that position, the locking tang 1 is introduced all the way into the device, and the locking slide 1 is displaced all the way to the right to its closing position, by the upper wedge face 3 of the thrust wedge that is embodied on the locking tang 1.

In other words, the wedge thrust gear mechanism formed by the wedge faces 3, 4 and the guide faces 13, 14 serves to reverse the thrust, converting the insertion motion of the locking tang 1, which extends in translational fashion in the insertion direction 34, into a likewise translational motion of the locking slide 9 in the displacement direction 31 extending at right angles to the insertion direction 34.

Analogously, when the appliance door is pulled open from outside or pushed open from the inside of the machine, an opening force extending precisely opposite the insertion force vector 36 and likewise extending in the insertion direction 34 comes into play. Upon force engagement of the opening force, correspondingly the lower wedge face 4 of the thrust wedge embodied on the locking tang 1 engages the corresponding lower guide face 13 of the wedge guidance groove 12 and in a sense pulls the saddle 11 and thus the locking slide 9 as well back out of its closing position into its opening position for the appliance door—toward the left in the drawing figures.

Figure 3:
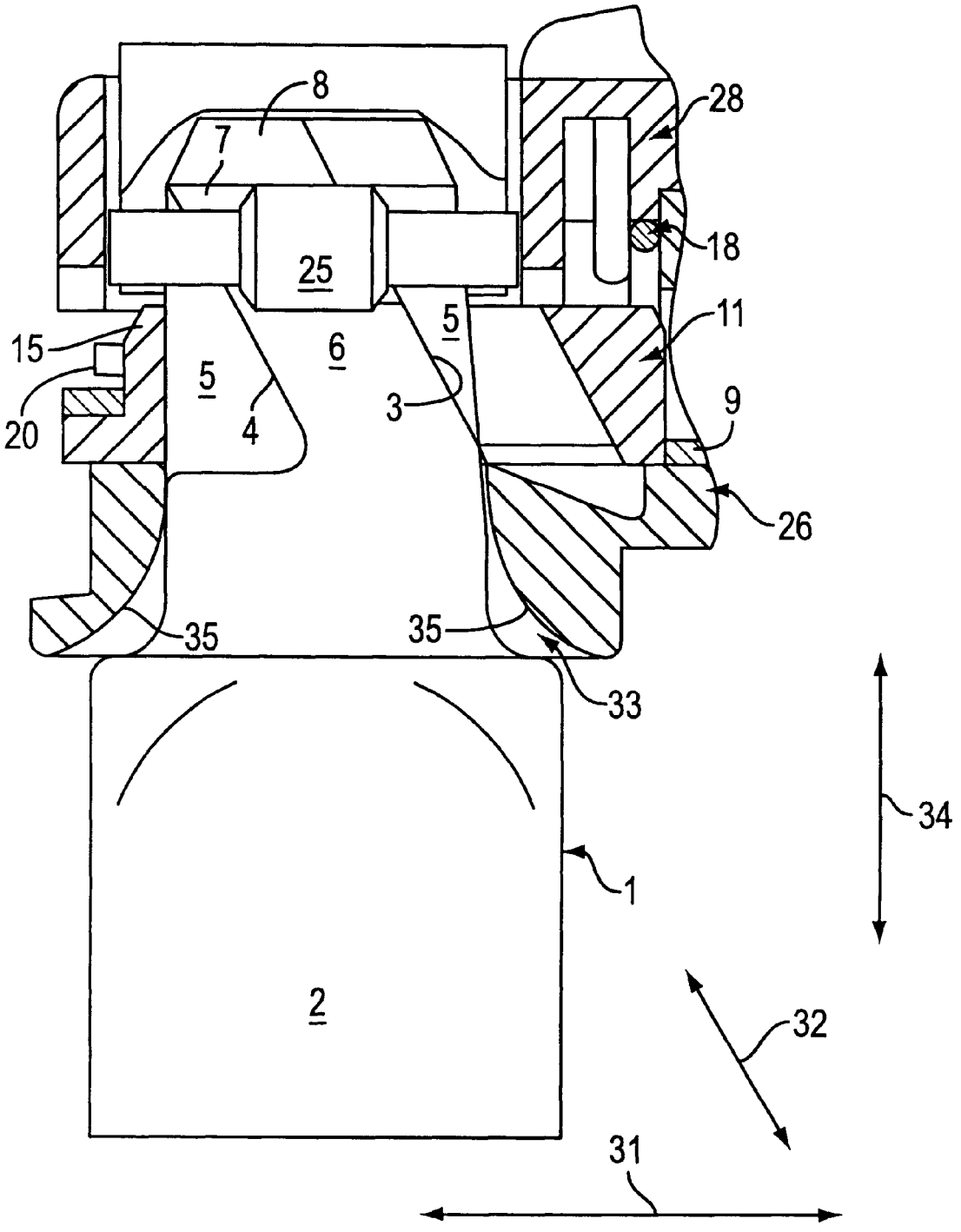
FIG. 3 is a longitudinal section through the lock with a locking tang locked in place in detent fashion.
Figure 4:
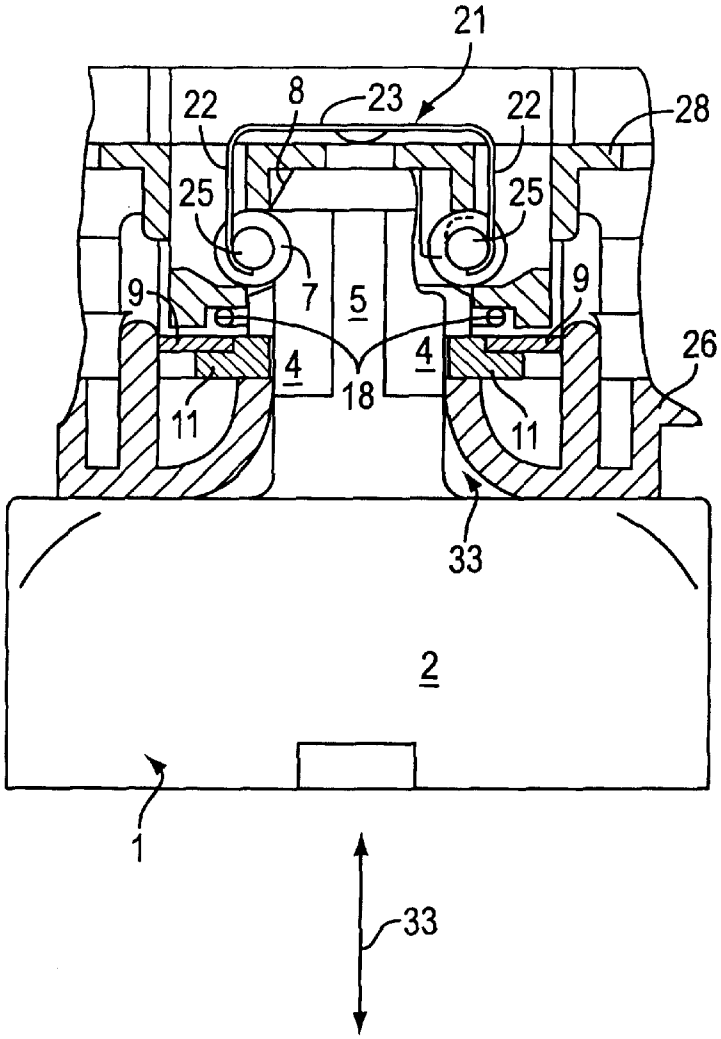
FIG. 4 is a cross section through the lock with the locking tang locked in detent fashion.
Figure 5:
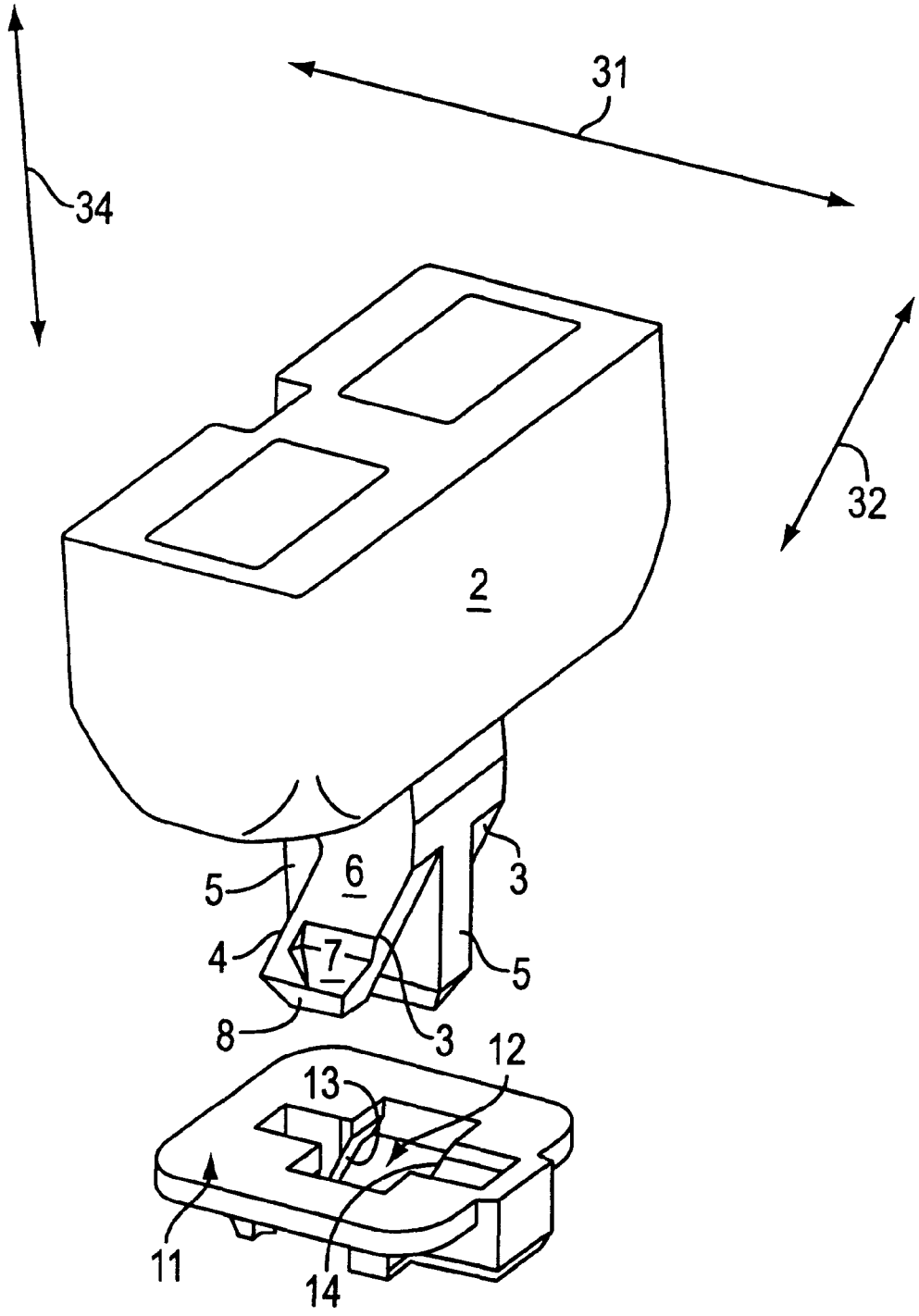
FIG. 5 is a perspective view of the locking tang and of the saddle.

When the locking tang 1 is inserted into the introduction opening 33, the runup cone 8 soon meets the cylindrical rollers 25 rotatably supported on the face ends 24 of the leaf spring legs 22. Because of its conical shape, the runup cone 38 continuously spreads the legs 22 of the leaf spring apart, so that the cone can continue to engage in the insertion direction 34 between the rollers 25 or leaf spring legs 22. In its completely closing position, shown in FIG. 3, the rollers 25 have run all the way over the runup cone 8 and have snapped into the channels 7 in the side faces 6 of the locking tang 1.

Figure 8:
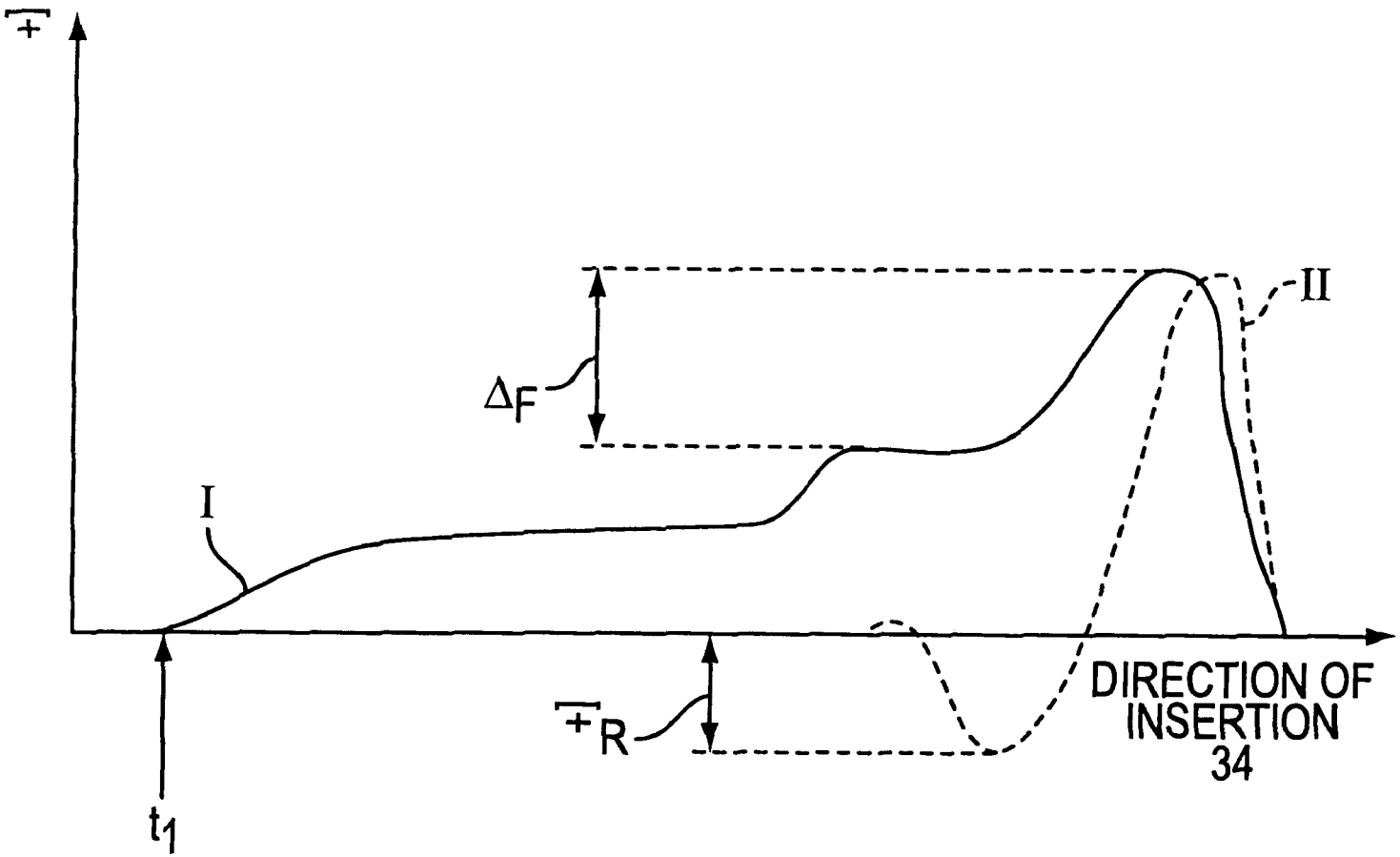
FIG. 8 is the course of forces involved in the prelocking, embodied by the rollers and the channels, upon closing and opening of the appliance door.

It is evident that as the distance in the insertion direction increases, the force required to spread the leaf spring legs 22 or rollers 25 apart increases progressively. This is represented in FIG. 8 by the solid-line curve I. Particularly in the region in which the rollers overtake the runup cone in order to snap into the channels 7, a strong supplementary force is required. This supplementary force is represented in FIG. 8 by the symbol $\Delta_F$. As a consequence of this required $\Delta_F$, a clearly audible snapping noise is generated as the rollers 25 snap into the channels 7. In addition, the $\Delta_F$ creates a pronounced snapping feeling in the hand of the user. Curve I in FIG. 8 begins at point $t_1$ with the force expenditure required to displace the locking slide 9. The rollers 25 together with the channels 7 form a prelocking means for the appliance. Finally, the locking slide 9 moved into its closing position is electrically closed from the machine itself.

Along with their function as a prelocking means, the rollers 25 have a second function as well. Specifically, as soon as the rollers 25 run back onto the runup cone 8 as the locking tang 1 is being pulled out, the leaf spring legs 22 have a tendency to move toward one another in spring-elastic fashion, and a result the rollers 25 are rolled along the runup cone 8 and thus press the locking tang 1 out of the introduction opening 33 and at the same time push the appliance door open. This represented in FIG. 8 by the dashed-line curve II. The force symbolized by $F_R$ represents the force that the rollers 25, operative as contact-pressure rollers in the opening of the appliance door, exert on the runup cone 8 in the direction counter to the insertion force vector 36.

Figure 6A:
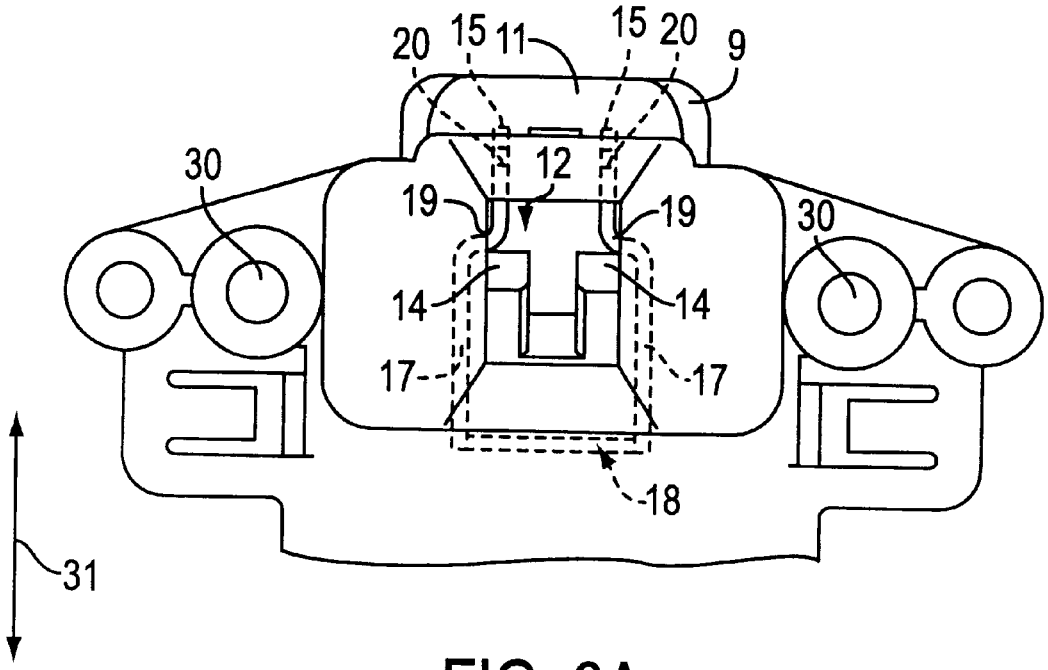
FIG. 6*a* is a sectional view from below of the introduction opening in the lock for the locking tang with the thrust latch activated.
Figure 6B:
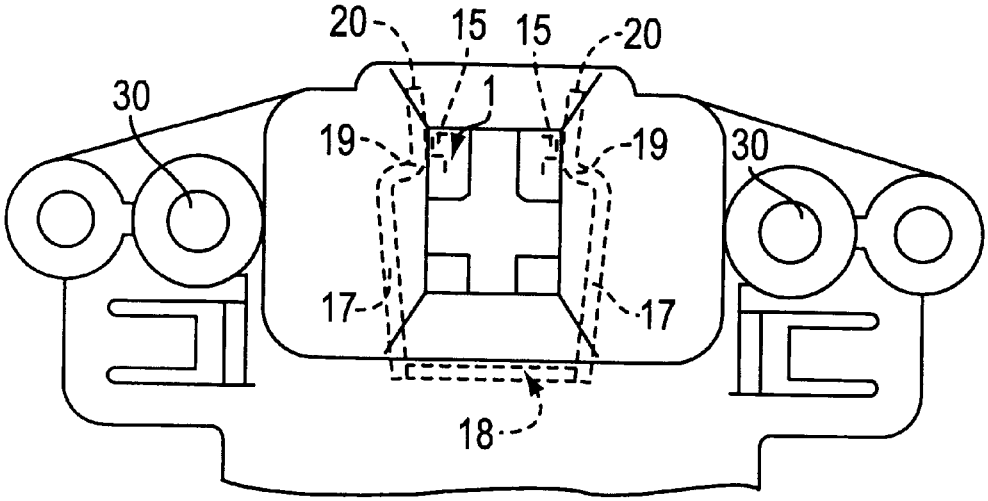
FIG. 6*b* is a sectional view from below of the introduction opening in the lock for the locking tang with the thrust latch deactivated.

As the locking tang 1 is introduced into the introduction opening 33, the regions of the upper regions, adjacent to the runup cone 8, of the upper wedge face 3 on the locking tang 1 and of the upper guide face 14 of the saddle 11 immediately slide on one another. The runup cone 8, however, meets the right-angled regions of the bracing spring 18 that protrude into the wedge guidance groove. These are the regions of the bracing spring 18 between the right-angle bends 19 and the face ends 20 of the bracing spring, as shown in FIG. 6. The face ends 20 of the bracing spring—as already noted several times—are then resting on the latch stops 15 of the saddle 11. The latch stops 15 are shown in dashed lines in FIGS. 6*a* and 6*b*, for the sake of clarity. If one wished to move the locking slide 9 in the displacement direction 11, then it can be seen from FIG. 6*a* that the latch stops 15 will strike the face ends 20 of the bracing spring legs 17 in the displacement direction 31. Consequently the legs 17 of the bracing spring, together with their face ends 20, form latch pins for the locking slide 9.

Upon insertion of the locking tang 1 in the insertion direction 34, the run up cone 8 meets the bracing spring legs 17 in the region of the right-angle bends 19 and spreads the legs 17 apart. As can be seen from FIG. 6*b*, the spread-apart bracing spring legs 17 release the saddle 11 with its latch stops 15, in such a way that the saddle 11 with the latch stops 15 can slide in the displacement direction 31 through the open legs 17 of the bracing spring. In the spread-open position of the bracing spring 18, the face ends 20 of the legs 17 of the spring can in fact no longer be made to engage the latch stops 15. An advantage of this thrust latch for the locking slide 9 is the location of the bent regions of the spring legs 17 in the wedge guidance groove 12. In this way it is possible in fact for the locking tang 1, with its runup cone 8, to optimally engage the bracing spring legs 17 and spread them apart. On the other hand, however, the bracing spring legs 17 must be spread apart so far that the saddle 11 with its latch stops 15 can also slide through the bent regions of the bracing spring legs 17, which are located markedly closer together than the other regions of the legs 17 of the bracing spring. Since moreover both legs 17 of the bracing spring must be displaced with increasing spring force toward one another, any manipulation of the locking device from outside is virtually impossible. In particular, any such manipulation will always require using more than a single tool.

With the device as described, it is moreover possible to lock and unlock an appliance door easily from both the inside and the outside; the unlocking is facilitated by the described dual function of the rollers 25 in cooperation with the runup cone 8.

Figure 9:
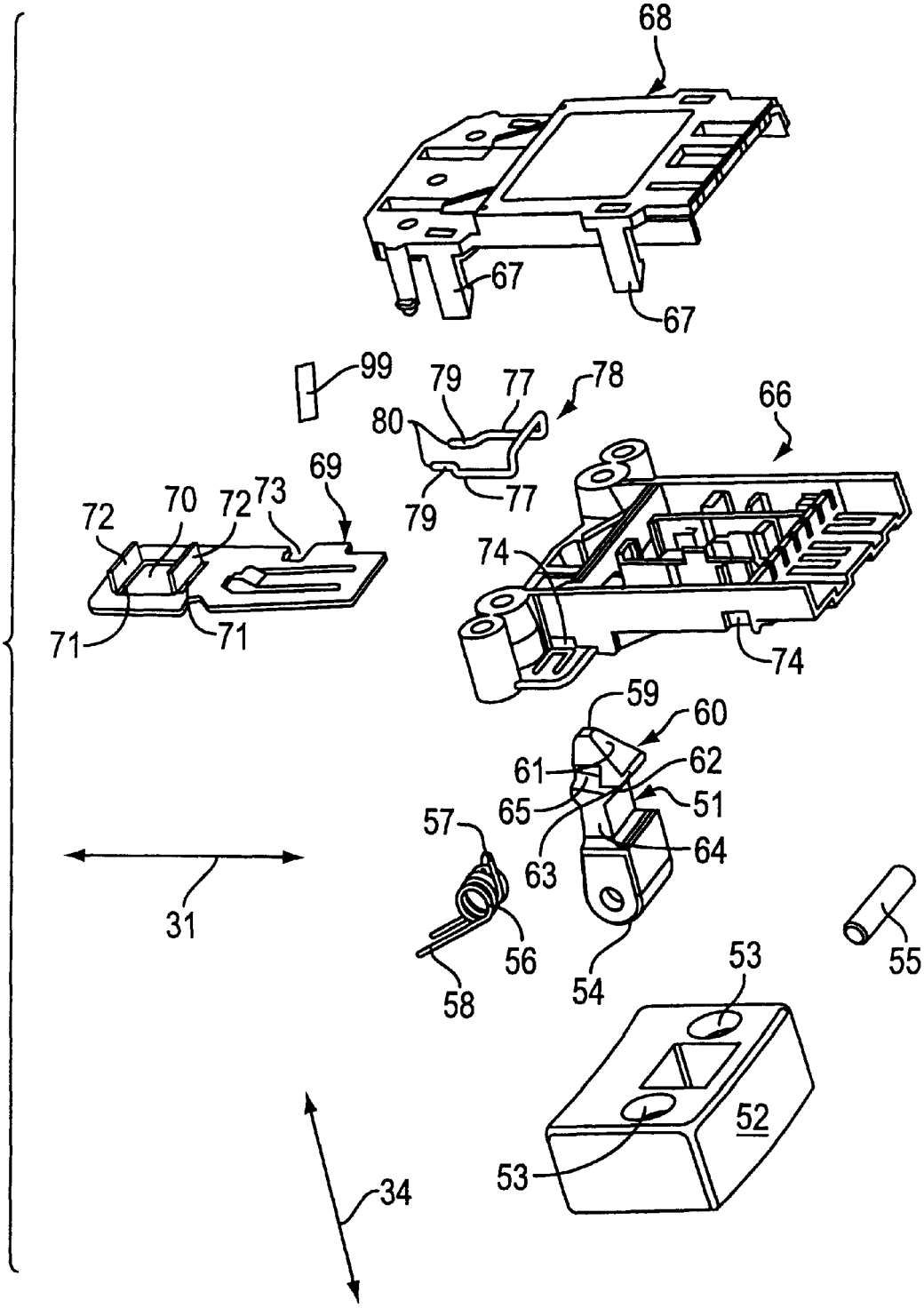
FIG. 9 is an exploded view of a second exemplary embodiment of the invention.

In the second exemplary embodiment of the invention shown in FIG. 9, the locking tang 51 is pivotably supported in a bearing block 52. The bearing block 52 is in turn secured to the appliance door, which is not shown in FIG. 9. To that end, the bearing block 52 is pierced by two through holes 53. Fastening screws, which are also screwed into the appliance door not shown in the drawing, can be passed through these through holes 53. With its bearing end 54, the locking tang 51 is supported pivotably about the hub 55 in the bearing block 52 counter to the spring force of the leg spring 56. The leg spring 56 is supported here by its short leg 57 in the bearing end 54 of the locking tang 51. By its long leg 58, the leg spring 58 is braced in the bearing block 52, or against the appliance door not shown in the drawing.

The face end 59 of the tang is remote from the bearing end 54 in the insertion direction 34. The cam 60 of V-shaped cross section protrudes in the displacement direction 31 from the side face, adjoining the face end 59, of the locking tang 51. The region of the cam 60 adjacent to the face end 59 of the tang and forming the outside of one leg of the V is the lead-in chamfer 61. Remote from the lead-in chamfer 61 in the insertion direction 34 is the sliding guide chamfer 62 that forms the second leg of the V-shaped cross section of the cam 60. The lead-in chamfer 61 and the sliding guide chamfer 62 both end at the apex edge 63. The side faces 64 of the locking tang 51 extend at right angles to the lead-in chamfer 61 and the sliding guide chamfer 62. The channels 65 are in turn formed into the side faces 64. The side faces 64 taper conically in the region between the face end 69 of the tang and the channels 65, in order to make it easier to introduce the locking tang 51 into the lock.

The locking slide 69 is pierced on one end by the rectangular scanning opening 70. At least the opening edges 71 of the scanning opening 70 that extend crosswise to the displacement direction 31 are bent out at right angles, in order to form the guide tongues 72 that protrude at right angles from the locking slide 59. Also shown is the drop-in slot 73 of the blocking device 99, (this is present analogously in the locking slide 9 of FIG. 1).

Figure 13:
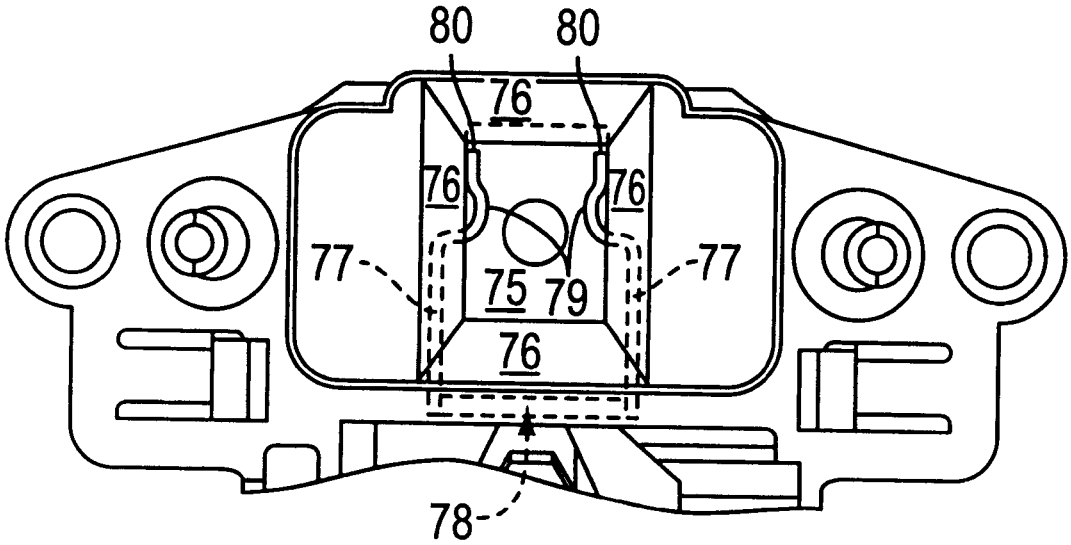
FIG. 13 is a view from below of the introduction opening in the appliance lock with the locking slide open.

The bracing spring legs 77 of the bracing spring 78 are provided with right-angle bends 79. In the final mounted state, the bracing spring 78 supported in the lock housing is disposed in such a way, relative to the locking slide 69 located in its opening position, that the right-angle bends 79 come to rest, in the insertion direction 34, above the scanning opening 70 and protrude laterally into the scanning opening 70 (FIG. 13). With their face ends 80, the legs 77 of the bracing spring act upon the adjoining guide tongue 72 of the locking slide 69 and thus inhibit any displacement of the locking slide 69 in the displacement direction 31.

The lock housing is formed of the housing bottom 66 and the housing cap 68 locked in detent fashion to the housing bottom 66 by means of detent hooks 67. For fixing the housing cap 68 on the housing bottom 67, the detent hooks 67 injection molded integrally with the housing cap 68 engage corresponding detent recesses 67 of the housing bottom 66.

Figure 10:
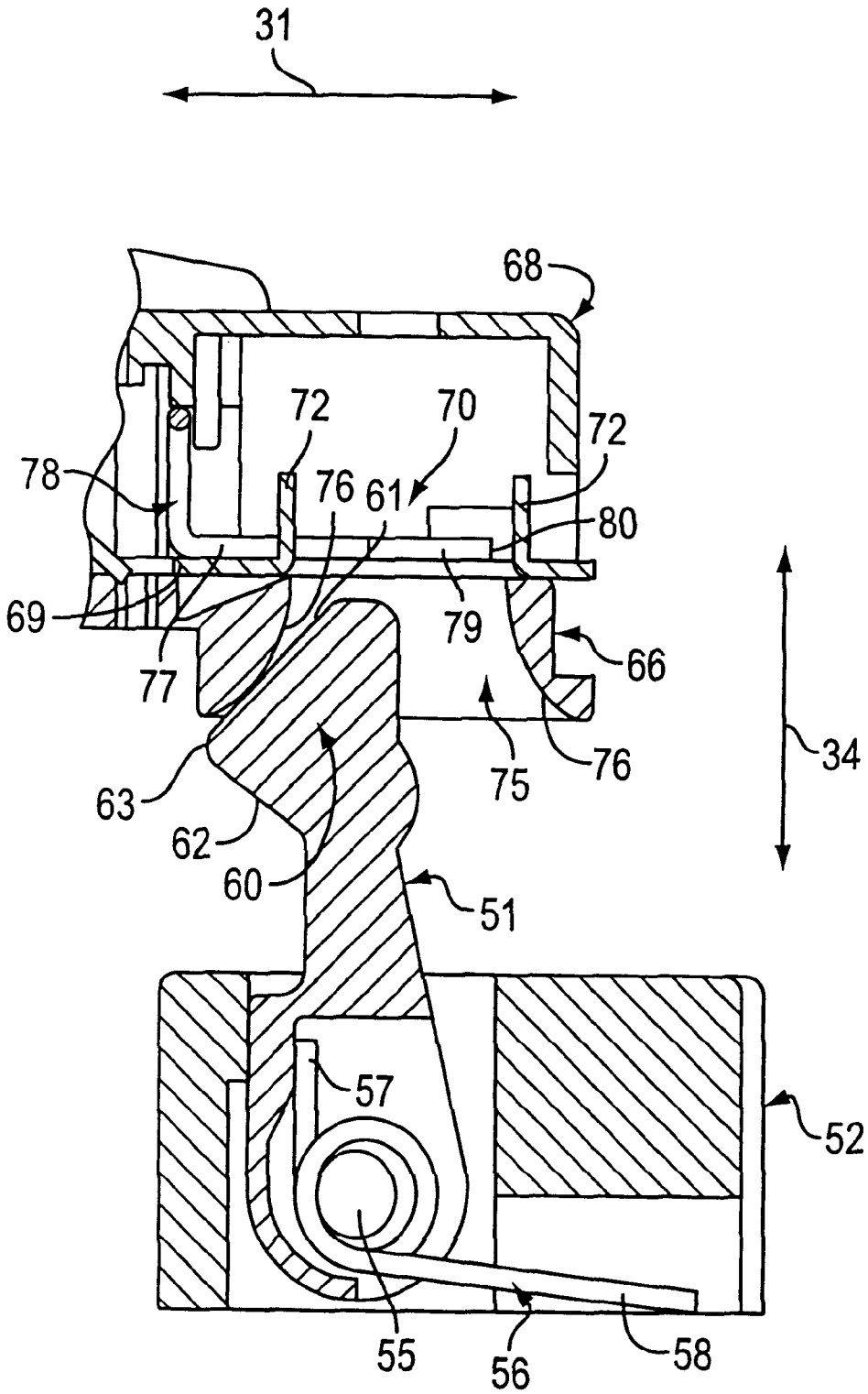
FIG. 10 is a sectional side view of the device before the introduction of the locking tang.

When the housing is in the closed state (FIG. 10), the locking slide 69 rests so as to be longitudinally displaceable in the displacement direction 31 in the housing bottom 26. FIG. 10 shows the opening position of the locking slide 69. In this opening position, the scanning opening 70 of the locking slide 69 on the one hand and the introduction opening 75 of the housing bottom on the other are in alignment. That is, the introduction opening 75 and the scanning opening 70 are congruent and in this locking slide position also rest congruently on one another.

Also visible are the face ends 80 of the bracing spring, which rest on the guide tongue 72 on the right-hand side of the drawing and thus cancel the longitudinal displaceability of the locking slide 69 in the displacement direction 31. In other words, the locking slide 69 is latched in its opening position.

Figure 11:
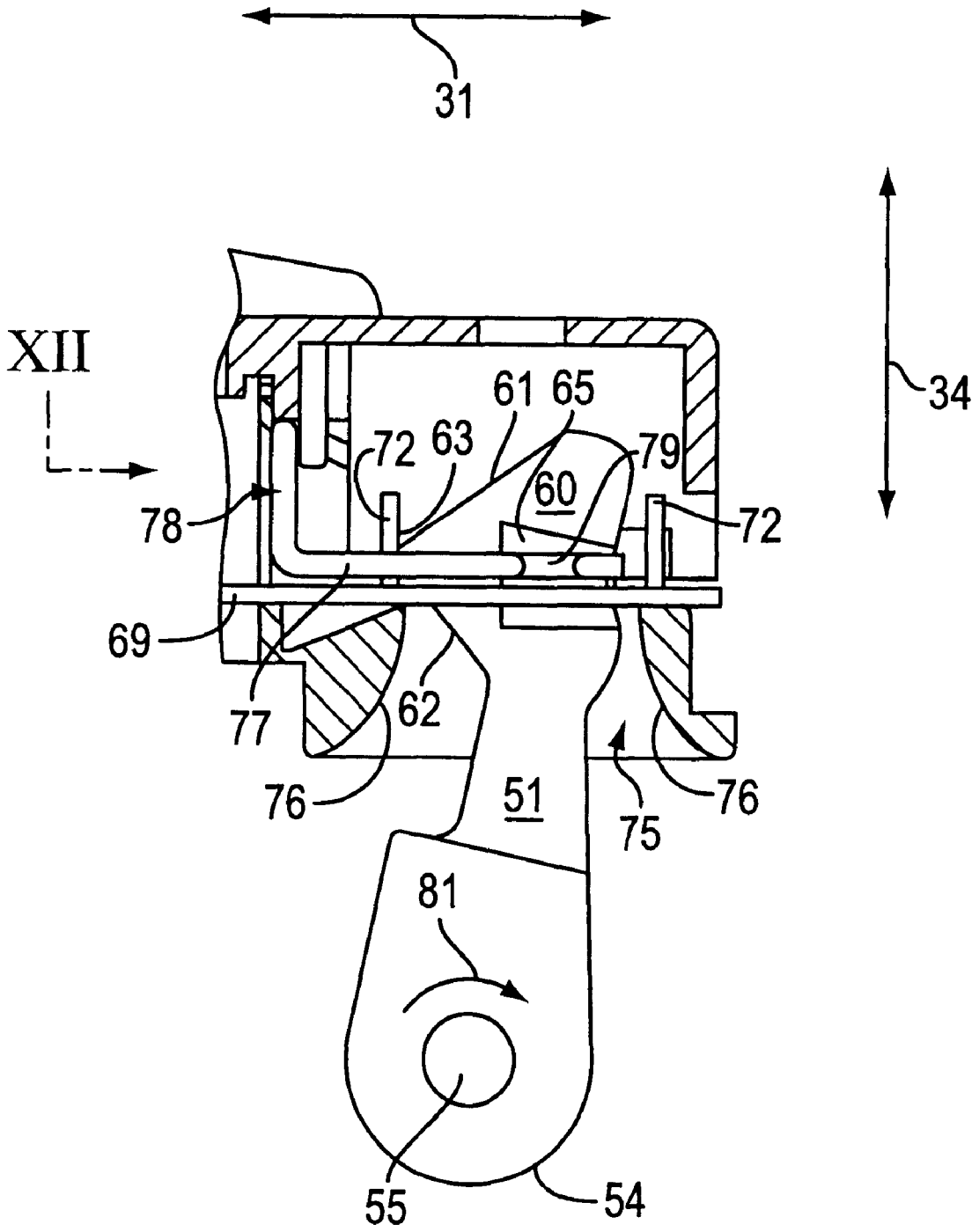
FIG. 11 is a side view of the locking tang, introduced partway into a lock shown in section.
Figure 12:
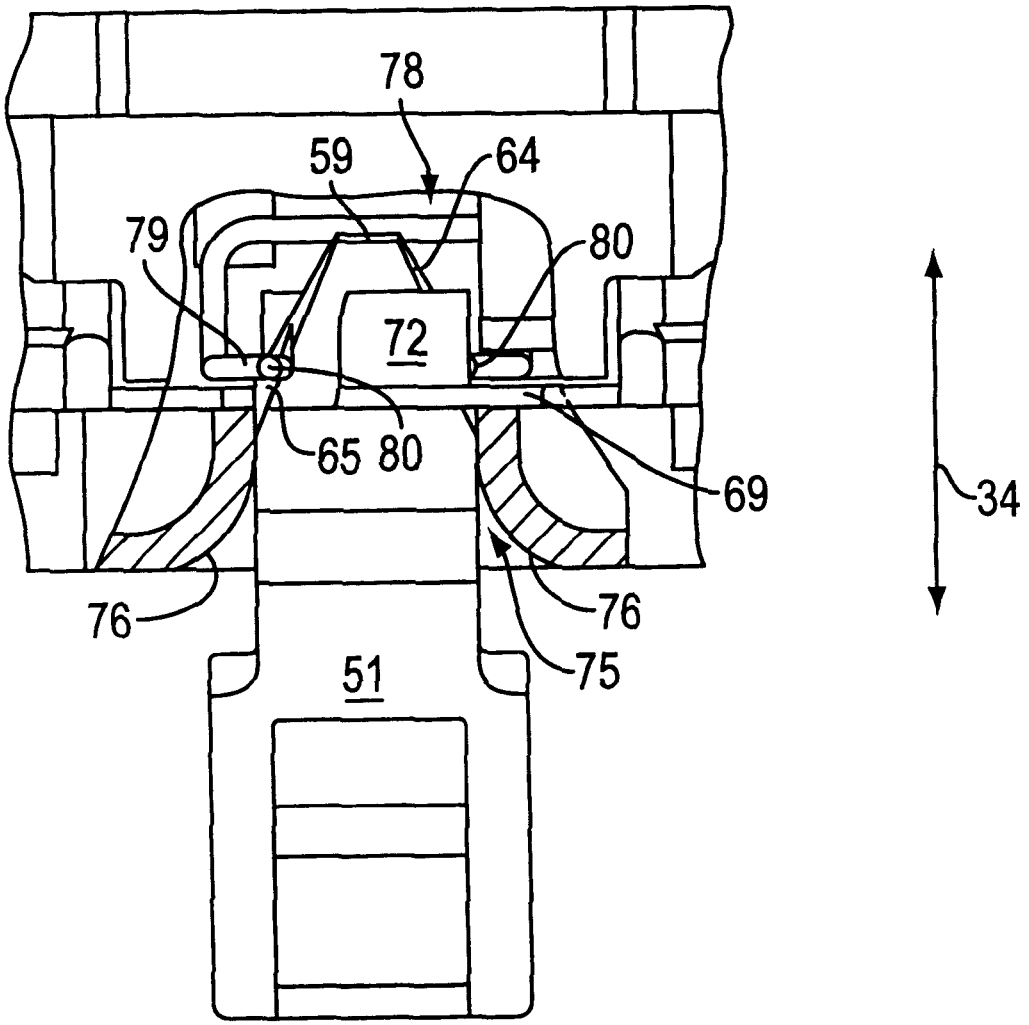
FIG. 12 is a front view seen in the direction of the arrow XII in FIG. 11.

Also visible in FIG. 10 is the locking tang 51, which rests with its lead-in chamfer 61 on the edge of the introduction opening 75. This edge of the introduction opening 75 is funnel-like and thus forms an introduction funnel 76. The V shape of the cam 60, which essentially comprises the sliding guide chamfer 62 and the apex edge 63, can be seen very clearly in FIG. 10. The mode of operation of the second exemplary embodiment will now be described, with further individual characteristics, in conjunction with the drawing figures described below:

In the view in FIG. 11, which is a side view of the locking tang 51 and a section through the lock housing, the locking tang 51, compared with the view in FIG. 10, is thrust farther into the lock in the insertion direction 34; that is, compared with the view of FIG. 10, the appliance door has been closed a little more. It can be seen here that the locking tang 51 has pivoted in the pivoting direction 81, counter to the pressure of the short spring leg 57 of the leg spring 56. The cam 60 has already slid with its lead-in chamfer 61 all the way into the introduction opening 75 via the introduction funnel 76, so that now the apex edge 63 acts upon the guide tongue 72 on the left in terms of FIG. 11, on the opening edge 71 of the scanning opening 70. However, the locking slide 69 is still in its opening position, because in this position the bracing spring 78 has not yet been unlocked. In FIG. 12, which shows the front view of the view of FIG. 11 in the direction of the arrow XII, or in other words the view of FIG. 11 rotated 90° about the axis of the insertion direction 34, it can be seen that the face ends 80 of the bracing spring, in this position, sill rest locking on the guide tongue 72 provided in the view of FIG. 11.

With its right-angle bends 79, the bracing spring 78 rests in the channels 65 of the locking tang 51. The position of the bracing spring 78 that corresponds to the views of FIG. 11 and FIG. 12 is shown in FIG. 13. FIG. 13 is a view from below of the introduction opening 75, but without the locking tang. FIG. 13 is thus equivalent to the elevation view of the lock when the appliance door is open.

Figure 16:
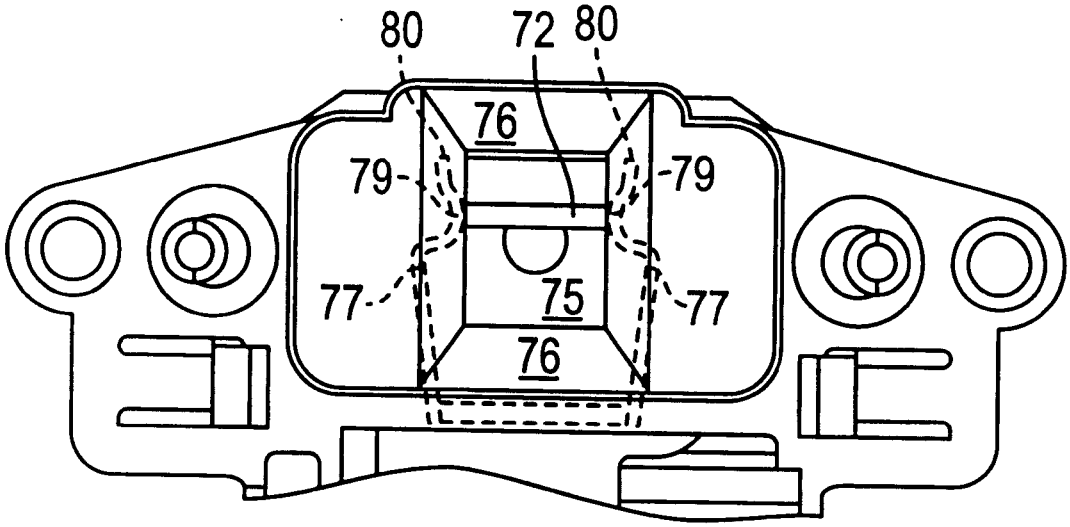
FIG. 16 is a view from below of the introduction opening in the appliance lock with the locking slide moved into its closing position.
Figure 14:
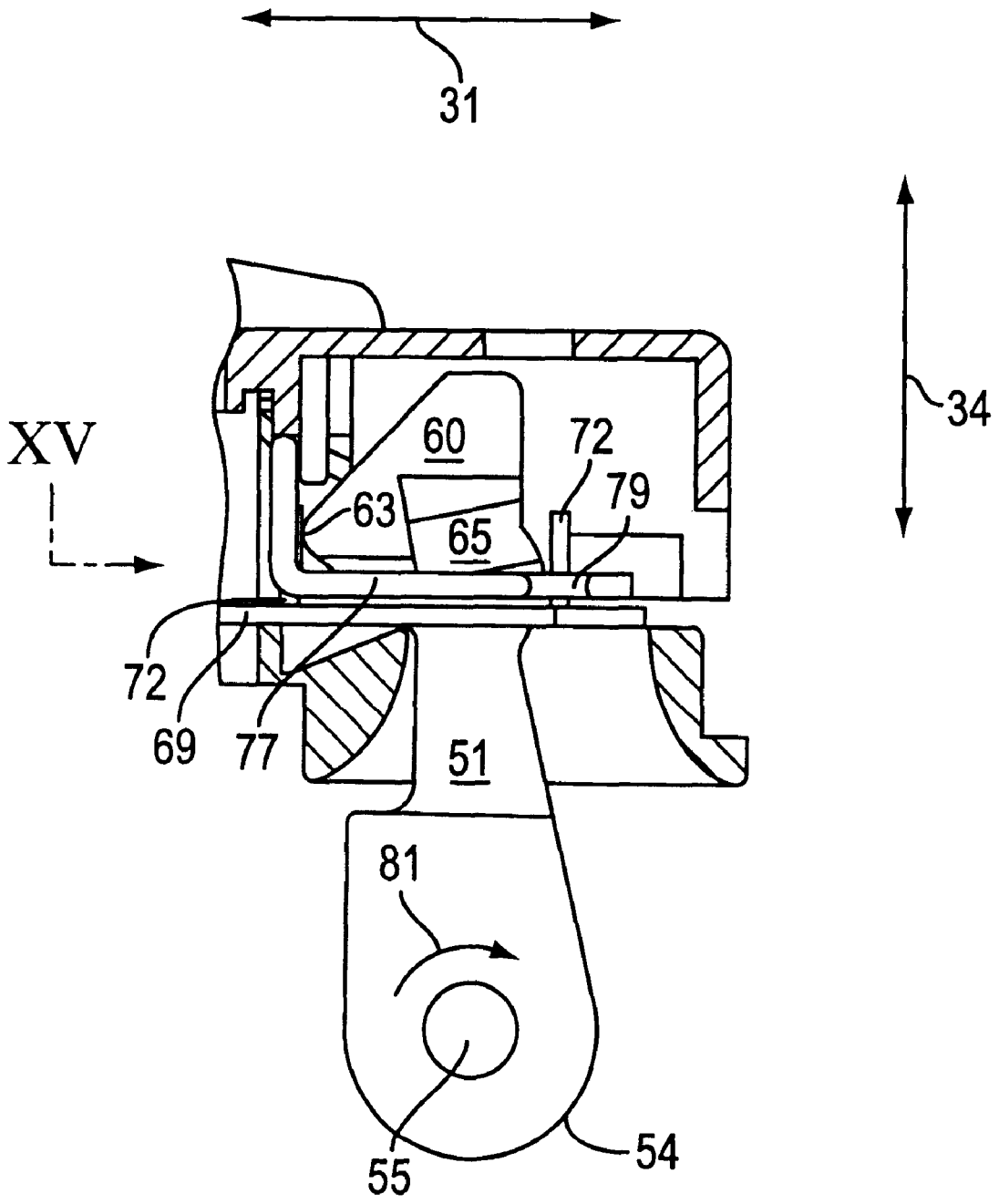
FIG. 14 is a side view of the locking tang introduced all the way into a lock shown in section.
Figure 15:
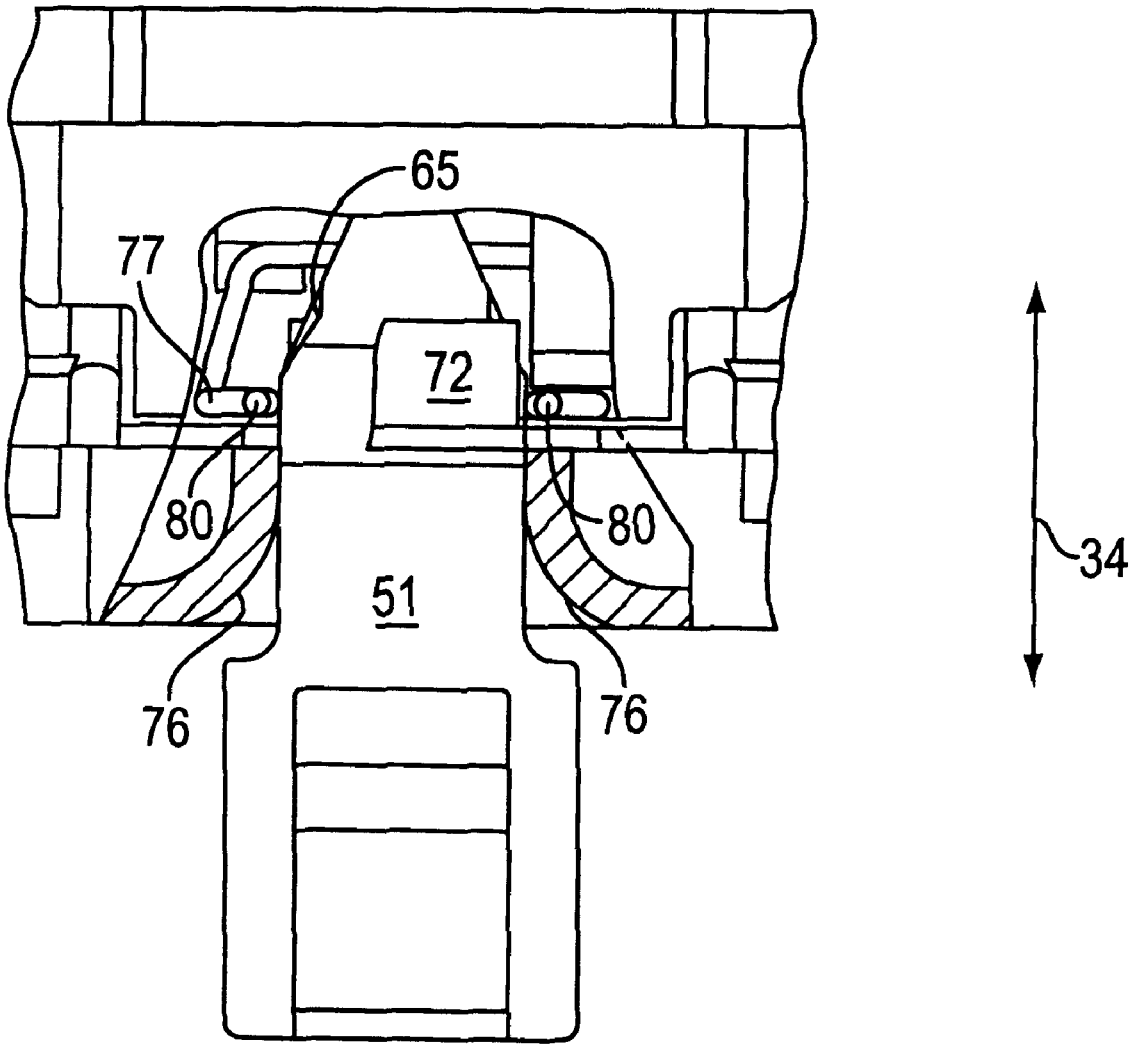
FIG. 15 is a front view seen in the direction of the arrow XV in FIG. 14.

FIG. 14 has the same perspective as FIG. 11. However, here the locking tang 51 is located entirely inside the lock. The locking slide 69 has also moved from its opening position, shown in FIG. 11, in the displacement direction 31 into its closing position. FIG. 15, analogously to FIG. 12, shows the front view in accordance with the arrow XV in FIG. 14. FIG. 16, in turn, shows the view from below of the introduction opening 75. For the sake of greater clarity, once again the locking tang 51, which is absolutely required in reality, has been left out. However, the guide tongue 72 embodied on the opening edge 71 of the scanning opening 70 can be seen; it keeps the legs 77 of the bracing spring spread apart in the region of the right-angle bends 79, because the positional securing means for the locking slide 69 in the view of FIGS. 14, 15 and 16 is deactivated, for the displacement of the locking slide 69 into its closing position.

The spreading apart of the spring legs 77 will now be explained, in conjunction with FIGS. 11 and 12. While in the view of FIGS. 11 and 12 the right-angle bends 79 rest in the channels 65 in the side faces 64 of the locking tang 51, in FIGS. 14 and 15 the locking tang has been thrust farther into the lock in the insertion direction 34. As a result of this displacement of the locking tang 51, the channels 65 slide along the bends 79 of the bracing spring legs 77 and come out of engagement with the bracing spring legs 77, and as a consequence now the body of the locking tang, extending over the full width of the locking tang 51, spreads the spring legs 77 apart (FIG. 16). Because of this spreading apart, the face ends 80 of the bracing spring, on the one hand, and the guide tongue 72, on the other, come out of engagement, which is shown particularly clearly in FIG. 15. As a consequence of the prestressing of the spring 56, which is present because of the deflection of the spring legs 56, the locking tang 51 is pivoted counter to the pivoting direction 81, out of its position shown pivoted in FIG. 11, back into its position of repose shown in FIG. 15. In this process, the apex edge 63 acts upon the guide tongue 72 on the opening edge 71 of the scanning opening 70 that was originally not acted upon by the face ends 80 of the bracing spring, that is, the guide tongue shown on the left in FIGS. 11 and 14. Consequently the apex edge 63 is operative as a cam 60, in such a way that because of the spring pressure, it displaces the locking slide in the displacement direction 31 into its closing position, which is shown in FIG. 14.

Figure 17:
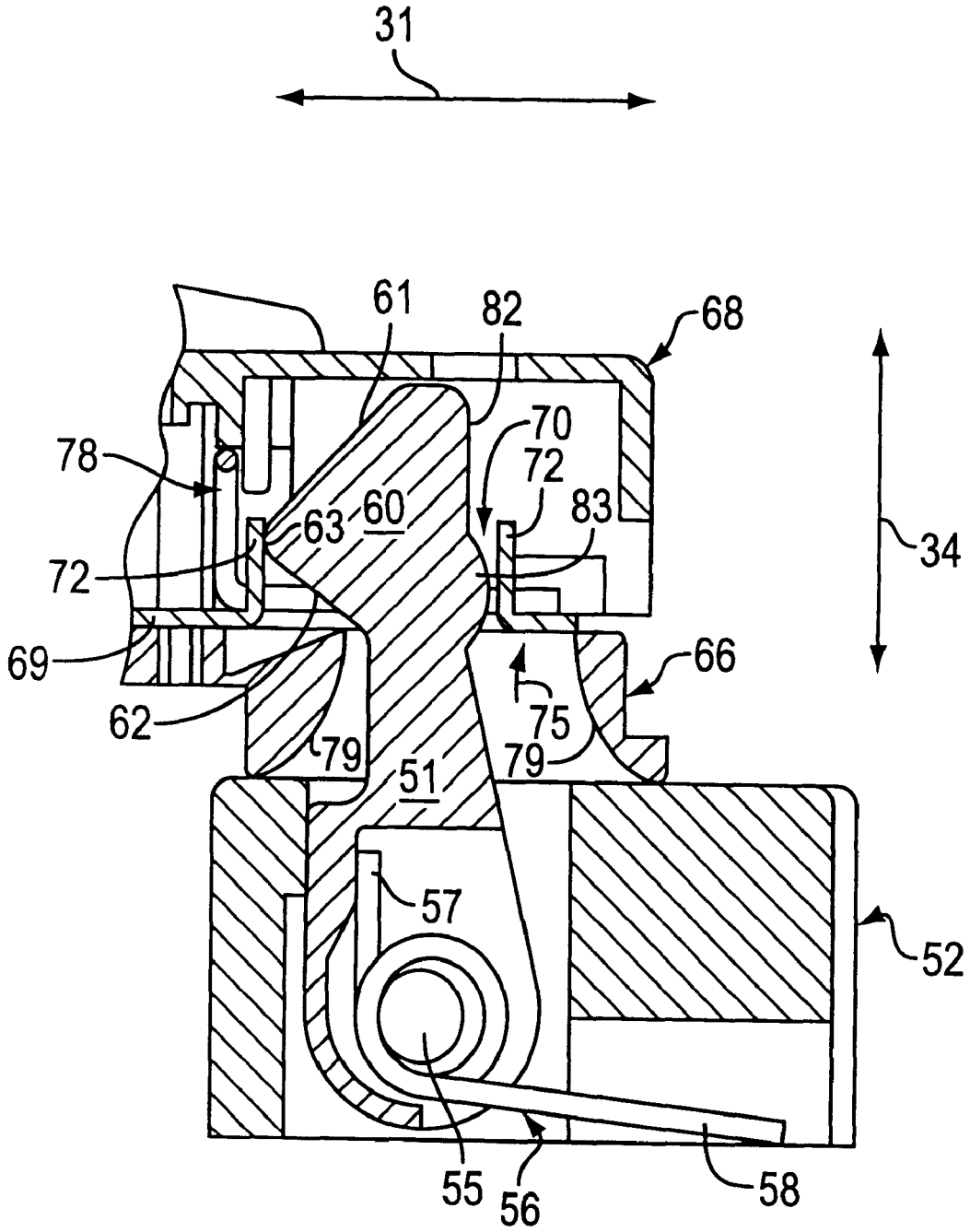
FIG. 17 is a sectional side view of the device with the locking tang introduced, in the closing position.
Figure 18:
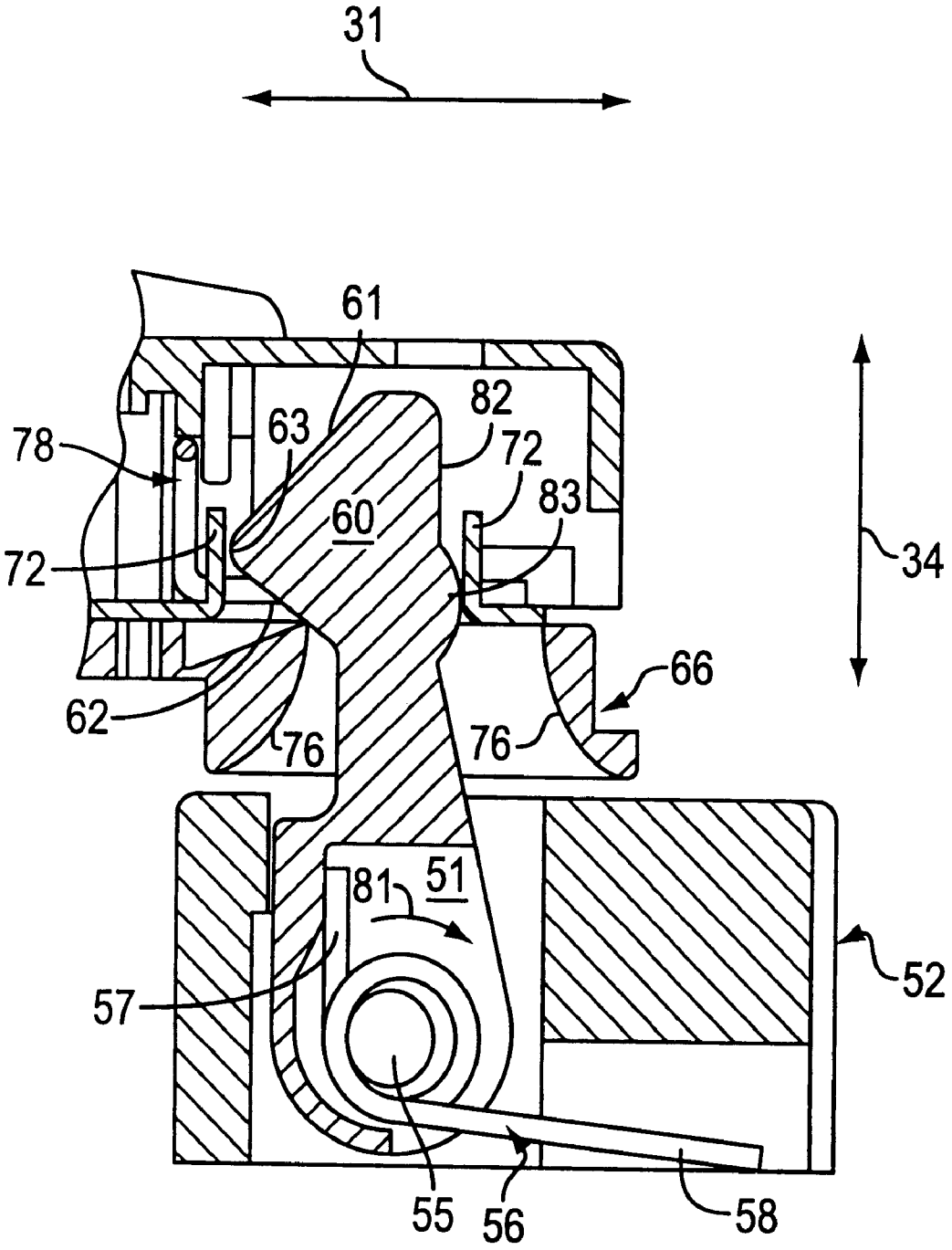
FIG. 18 is a sectional side view of the device with the locking tang introduced, in the partly open position.
Figure 19:
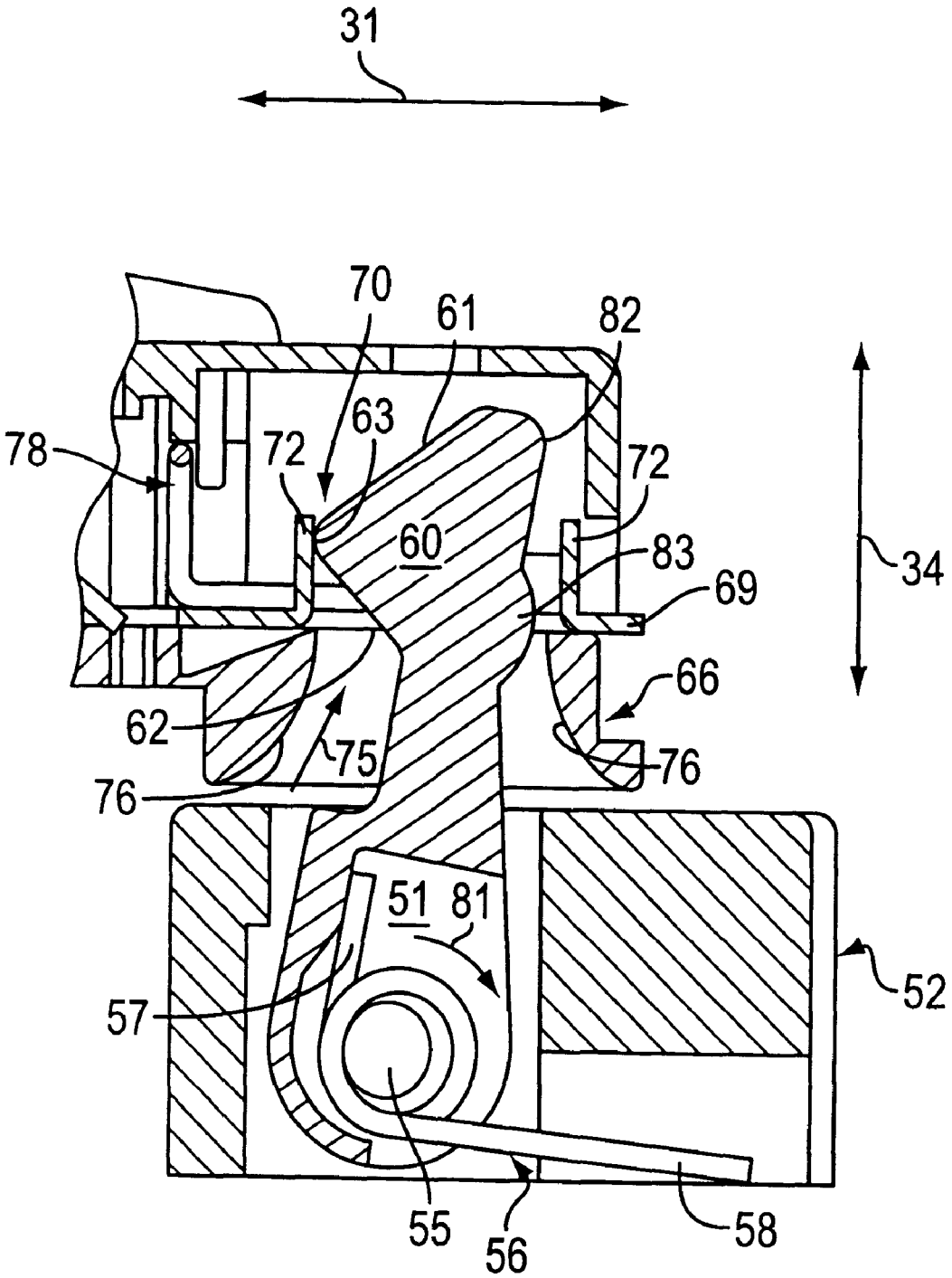
FIG. 19 is a sectional side view of the device with the locking tang introduced and with the locking slide moved back into its opening position.

FIG. 17 shows the closing position of the locking slide 69, which is also shown in FIG. 14. However, FIG. 17 shows the same sectional plane as FIG. 10. From the sectional views of FIGS. 17, 18 and 19, the gear mechanism kinematics upon opening of the appliance door will now be explained in more detail. In the closing position of the locking slide 69, the cam 60 rests entirely within the scanning opening 70 of the locking slide 69. The locking tang 51 has been pivoted back into its outset position. If the blocking device, not shown in the drawings, is deactivated and pull is exerted on the door connected to the bearing block 52, then the locking tang 51 with the sliding guide chamfer 62 slides along the edge of the introduction funnel 76. In this process, the locking tang 51 is already pivoted a certain distance in the pivoting direction 81, counter to the spring force of the short leg 57 of the leg spring 56. It can also be seen from the view of FIG. 18 that the apex edge 63 pivots in the displacement direction 31, and that its associated guide tongue 72, shown on the left in FIG. 18, lifts away from it to a certain extent. In this return position, shown in FIG. 18, the backside 82 of the tang, remote from the cam 60, rests on the other guide tongue 72, shown on the right in FIG. 18, of the locking slide 69. For that purpose, the back side 82 of the tang has a hump 83 in the region of the guide tongue 72. By the contact of the sliding guide chamfer 62 with the edge of the introduction funnel on the one hand and by the action of the hump 83 on the guide tongue 72 on the other, the locking slide is necessarily moved in the displacement direction 31 into its opening position by the further pulling out of the locking tang 51 and the attendant increasing spacing of the bearing block 52 from the housing bottom 66. This opening position is reached as soon as the introduction opening 75 on the one hand and the scanning opening 70 on the locking slide 69 on the other again rest one above the other congruently in the insertion direction 34, as suggested in FIG. 19. In this position, the bracing spring legs 77, with their face ends 80, again secure the location of the locking slide 69 in its opening position, by contact with the guide tongue 72 shown on the right in FIG. 19. From its position shown in FIG. 19, the locking tang 51 can simply be pulled out of the lock into its outset position shown in FIG. 10; in this process, the apex edge 63 of the cam 60 first slides downward along the guide tongue shown on the left in FIG. 19, and then slides out of the lock along the introduction funnel 76.

In comparison with the first exemplary embodiment described, the second exemplary embodiment that has just been described makes possible a better compensation for errors in tolerance between the door and the body of the appliance.

What is claimed is:

1. A door locking device for an electrical appliance having a door, comprising:

a lock having a locking slide movable back and forth between an opening position and a closing position;

a blocking device for arresting the locking slide in its closing position;

a locking tang which drops into the lock when the appliance door is being closed and engages with the locking slide when the appliance door is in a closed state, the locking tang dropping out of the lock when the door is being opened;

a gear mechanism, operative between the locking slide and the locking tang, for converting the dropping-in motion of the locking tang upon closure of the appliance door and the dropping-out motion of the locking tang upon opening of the appliance door into a displacement motion of the locking slide when the blocking device is not arresting the locking slide;

means for guiding the locking tang in the lock so that motion of the appliance door when the blocking device is not arresting the locking slide moves the locking slide in the direction of its opening position; and a thrust latch, operative when the appliance door is open, on the locking slide having a latch stop disposed on the locking slide and a latch pin that rests on and locks the latch stop when the appliance door is open, the latch pin being moved by the locking tang into an opening position that releases the latch stop when the appliance door is in the closed state.

2. The device of claim 1, wherein the gear mechanism is a cam gear mechanism, comprising:

a scanning opening having an opening edge in the locking slide;

the locking tang comprising a guide rod and pivotably supported on a free end thereof that forms the bearing end (54); and a cam, on another free end of the locking tang remote from the bearing end so that the cam protrudes into the scanning opening and rests slidingly on the opening edge when the locking tang drops into the lock.

3. The device of claim 2, wherein the cam has a V-shaped region having an open edge and a pair of legs that protrudes from the locking tang in a direction of the opening edge of the scanning opening so that the apex edge of the V is toward the opening edge and the legs of the V together with the opening edge form a sliding guide, wherein the opening of the V forms a connection with the body of the locking tang.

4. The device of claim 3, wherein the tang has a face end and the leg of the V adjacent the face end of the tang is operative as a lead-in chamfer when the locking tang is dropping into the lock.

5. The device of claim 3, wherein the tang has a face end and the device further comprises an introduction opening congruent with the scanning opening and preceding the scanning opening in the lock, wherein the leg of the V, remote from the face end of the tang, of the cam has an outer face that rests slidingly on the edge of the introduction opening to provide a funnel for guidance of the locking tang.

6. The device of claim 2, wherein the cam has a V-shaped region having an apex edge and at least one leg and the apex edge of the V-shaped cam rests or an opening edge of a scanning opening, and wherein the cam provides a thrust wedge that moves the locking slide into the closing position.

7. The device of claim 6, wherein the tang has a back side, remote from the V region of the cam disk that comes into contact with the opening edge of the scanning opening, and the leg of the V rests slidingly on the edge of a funnel formed by an introduction opening of the lock, and guides the locking tang so that when the appliance door opens, the locking tang slides out of the lock and returns the locking slide to its opening position.

8. The device of claim 1, further comprising:

a U-shaped bracing spring having two legs supported in the lock, at least one of the legs having a face end and acting as the latch pin, so that the face end rests on the latch stop when the appliance door is open.

9. The device of claim 8, wherein both legs have face ends and act as respective latch pins, each face end resting on one latch stop when the appliance door is open, and wherein the bracing spring legs are spread apart by the locking tang in order to unlock the locking slide when the appliance door is in the closed state.

10. The device of claim 9, further comprising a scanning opening in the locking slide having edges that are one of bent at a right angle and crimped over, in order to form the latch stop.

* * * * *